United States Patent [19]

Takahashi et al.

[11] 3,930,966

[45] Jan. 6, 1976

[54] METHOD OF FORMING COLORED OXIDE FILM ON ALUMINUM OR ALUMINUM ALLOY

[75] Inventors: Toshiro Takahashi; Toshihiro Nagano, both of Shizuoka; Kenji Wada, Tokyo; Yasushi Suzuki, Shizuoka, all of Japan

[73] Assignee: Riken Light Metal Industries Company, Ltd., Japan

[22] Filed: Mar. 20, 1974

[21] Appl. No.: 452,724

[52] U.S. Cl. ..... 204/58

[51] Int. Cl.[2] ..... C25D 11/08; C25D 11/14

[58] Field of Search ..... 204/58, 35 N

[56] References Cited

UNITED STATES PATENTS

| | | | |
|---|---|---|---|
| 2,930,741 | 3/1960 | Burger et al. | 204/228 |
| 2,998,358 | 8/1961 | Nakayama | 204/58 |
| 3,468,772 | 9/1969 | Sheasby et al. | 204/58 |
| 3,669,856 | 6/1972 | Gedde | 204/58 |
| 3,717,555 | 2/1973 | Chakravarti et al. | 204/58 |
| 3,761,362 | 9/1973 | Oida et al. | 204/35 N |
| 3,790,452 | 2/1974 | Anderson et al. | 204/58 |
| 3,798,137 | 3/1974 | Kampert | 204/35 N |

OTHER PUBLICATIONS

Surface Treatment of Aluminum by Wernick et al., 3rd Ed., 1964, p. 337.

"Aluminum" by S. Wernick, et al., 3rd Ed., 1964, pp. 345–346.

*Primary Examiner*—R. L. Andrews

*Attorney, Agent, or Firm*—McNenny, Farrington, Pearne & Gordon

[57] ABSTRACT

A method of forming a colored oxide film on the surface of an aluminum material is disclosed in which the aluminum material is subjected to an electrolytic treatment in an aqueous solution containing sulfuric acid to form an aluminum oxide film containing aluminous oxides and having lattice defects; sulfuric ions in the solution are caused to enter into the lattice defects of the oxide film; some or all of the sulfuric ions are reduced to form sulfur and sulfides; and the colored oxide film is formed using the sulfur and sulfides as coloring sources.

5 Claims, 2 Drawing Figures

METHOD OF FORMING COLORED OXIDE FILM ON ALUMINUM OR ALUMINUM ALLOY

BACKGROUND OF THE INVENTION

1. Field of the Invention

This invention relates to a method of forming a colored oxide film on the surface of aluminum or an aluminum alloy, and more particularly to a method of forming a colored oxide film on the surface of aluminum or an aluminum alloy by effecting electrolysis in an electrolytic bath composed of an aqueous solution containing sulfuric acid, with the aluminum or the aluminum alloy being used as an anode or both as an anode and as a cathode.

2. Description of the Prior Art

In the prior art, an aluminum material is made resistant to corrosion or the like by subjecting it to an anodic oxidation treatment in an aqueous solution containing sulfuric acid. Coloring of the oxide film formed on the aluminum material is achieved by painting it with a dye or the like, or electrolytically by impressing an AC current between the aluminum material serving as an anode and a cathode in an aqueous solution containing sulfuric acid containing a metallic salt. However, coloring with dye is defective in easy deterioration of the dye, and electrolysis with AC current involves two electrolyzing steps, and hence is disadvantageous from the economical point of view.

Further, there has also been employed a method of forming a colored oxide film by subjecting an aluminum material to an anodic oxidation treatment in an electrolytic bath composed, for example, of sulfosalicyclic acid and sulfuric acid or a metal sulfate. This method forms a colored oxide film only with one electrolytic treatment at room temperature but employs, as an electrolyte, sulfosalicylic acid which is special and expensive, so that this method is very costly. In addition, with this method, the aluminum material is used as an anode only and cannot be used as an anode and a cathode at the same time.

SUMMARY OF THE INVENTION

One object of this invention is to provide a method of forming a colored oxide film on an aluminum material by subjecting the aluminum material to an anodic oxidation treatment in an aqueous solution containing sulfuric acid while impressing a pulse voltage to the aluminum material.

Another object of this invention is to provide a method of forming a colored oxide film on an aluminum material by subjecting the aluminum material to an electrolytic treatment in an aqueous solution containing sulfuric acid while impressing a rectangular pulse voltage to the aluminum material used as an anode or as both electrodes.

Another object of this invention is to provide a method of forming a colored oxide film on an aluminum material by subjecting the aluminum material to an anodic oxidation treatment in an aqueous solution containing 5 to 95% by weight of sulfuric acid.

Still another object of this invention is to provide a method of simultaneously forming a colored oxide film on aluminum materials used as both electrodes by alternately impressing pulse voltages of opposite polarities between the both electrodes in an aqueous solution containing only sulfuric acid.

In accordance with one aspect of this invention, an aluminum material is subjected to an electrolytic treatment in an aqueous solution containing sulfuric acid to form an oxide film containing aluminous oxides and having defects in its crystal lattice (which oxide film will hereinafter be referred to as an oxide film having lattice defects) and, in the case where sulfur or sulfides are formed in the oxide film, the sulfur or the sulfides act as coloring sources to provide a colored oxide film.

In accordance with another aspect of this invention, an aluminum material is subjected to an electrolytic treatment while being impressed with a pulse voltage, by which an oxide film with lattice defects is formed on the aluminum material.

In accordance with another aspect of this invention, at least 5.0% by weight of sulfuric acid is contained in an electrolyte, by which sulfur or a sulfide sufficient for coloring is formed in the oxide film having lattice defects.

In accordance with still another aspect of this invention, even if an aluminum material contains Mg, Fe, Si, Cu, Zn, Cr, Ti or other various alloying elements, an oxide film with lattice defects is formed on the aluminum material by subjecting the latter to an electrolytic treatment impressing thereto a pulse voltage because the above elements except Cu have a strong affinity for oxygen as is the case with aluminum. Further, in the aluminum material containing Fe and/or Si, the element acts as a coloring source to enhance the coloring effect of the colored oxide film.

DESCRIPTION OF THE PREFERRED EMBODIMENTS

Now, this invention will be described in detail.

Prior to electrolysis, an aluminum mterial is subjected to chemical pretreatments such, for example, as degreasing, rinsing and so on, and then subjected to a neutralizing treatment. The pretreatments may include not only chemical but also mechanical ones. Since the pretreatments are not directly related to this invention, no detailed description will be made of them.

After the above pretreatments, the aluminum material is subjected to electrolysis in an electrolyte containing at least 5.0% by weight of sulfuric acid, with the aluminum material being used as an anode or as an anode and a cathode, by which a film of an aluminum oxide containing aluminum suboxides and other elements and having defects in crystal lattice is formed on the aluminum material serving as the anode or as the anode and the cathode, and then sulfuric ions in the electrolyte are caused to enter into the lattice defects of the film to form therein sulfur and/or sulfides.

Namely, an oxide film containing suboxides of aluminum and other elements, such, for example, as AlO, $Al_2O$ or the like, lacks oxygen unlike an ordinary anodic oxide film composed principally of $Al_2O_3$. At the same time, the crystal lattice of the oxide film has defects, the number of which increases in the presence of the aluminum suboxides. The size of the lattice defects and the radius of the sulfuric ions are substantially equal to each other. Accordingly, there is the possibility of the sulfuric ions entering into the lattice defects of the oxide film. Further, where the ion radius of those ions of alloying elements and impurity elements in the aluminum material which are dissolved into the electrolyte is substantially the same as the size of the lattice defects, the ions of the alloying elements and the impurity elements are likely to enter into the lattice defects. Therefore, if supplied with sufficient energy during electrolysis, the sulfuric ions and the ions of the alloying elements and the impurity elements enter into lattice defects of the oxide film.

The sulfuric ions and the other ions having thus entered into the lattice defects lose their valence electrons therein and, at the same time, reduced to provide sulfur and sulfides or sulfates of the alloying elements or impurity elements. These products act as coloring sources to provide a colored oxide film.

Further, in order to form an oxide film containing suboxides of aluminum and other elements and having lattice defects, to cause sulfuric ions and other ions to enter into the lattice defects and to reduce them to produce sulfur and/or sulfides during electrolysis using the aluminum material as an anode or as an anode and a cathode, it is preferred to impress a pulse voltage for the following reasons.

Figure 1:
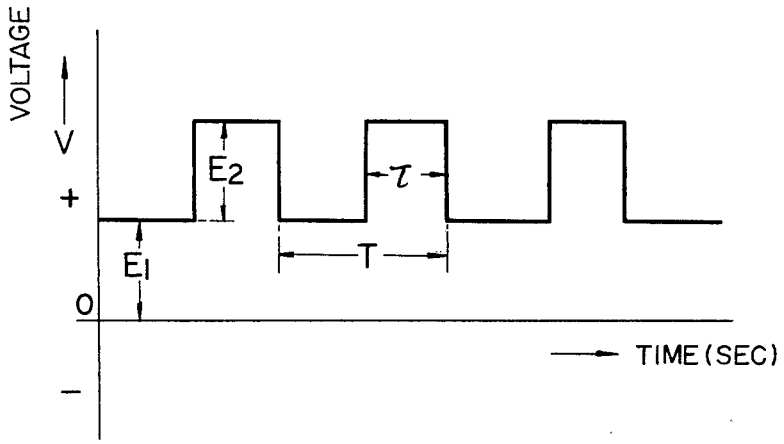
FIGS. 1 and 2 are voltage waveform diagrams, for explaining the operation of the system of this invention.

1. In the case of electrolysis using the aluminum material as an anode:

A rectangular pulse voltage shown in FIG. 1 is a voltage that a pulse of a peak voltage $E_2$ is superimposed on a base voltage $E_1$.

Consequently, in the case of using the voltage of such waveform as depicted in FIG. 1, an aluminum oxide film is formed on the aluminum material by the application of the base voltage $E_1$ and, in the process of formation of the oxide film, the rectangular voltage $E_2$ is applied on a cycle of a unit period T, so that a shock is given to the aluminum oxide film to produce therein lattice defects. The oxide film is insufficiently oxidized and aluminum and the other elements remain in the form of suboxides, so that the oxide film contains much the suboxides. The sulfuric ions in the electrolyte are strongly attracted to the aluminum oxide film of the above construction by momentarily impressing of the rectangular voltage $E_2$ with practically no rise time, so that the sulfuric ions are given energy sufficient to enter into the lattice defects.

When the sulfuric ions have enetered into the lattice defects of the aluminum oxide film in the above-described manner, since the suboxide of aluminum contained in the film has a strong reducing action, the sulfuric ions are reduced to form sulfur and sulfides to provide, for example, an amber oxide film.

Figure 2:
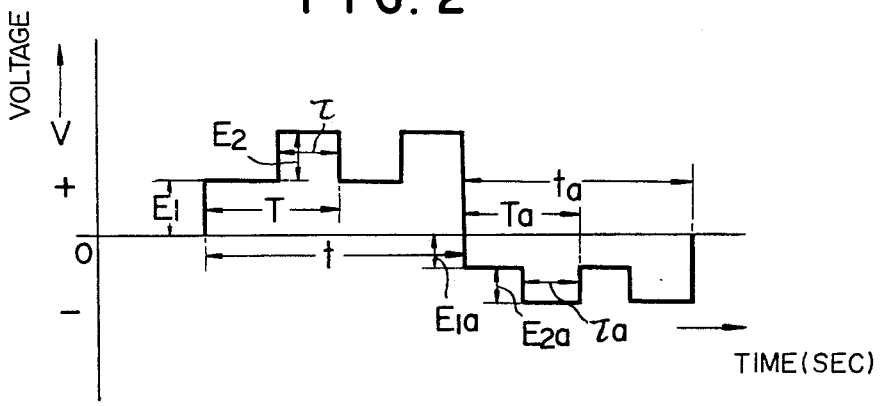

2. In the case of electrolysis using the aluminum materials as an anode and a cathode:

Since it is necessary to electrolyze both aluminum materials at the same time, a rectangular pulse voltage such, for example, as depicted in FIG. 2 whose polarity is altered at predetermined time intervals, is applied.

Namely, in the case of electrolysis employing such a rectangular pulse voltage as shown in FIG. 2, the polarity of the aluminum materials serving as the anode and the cathode is altered "positive" and "negative," for example, at every two periods. Consequently, while each of the aluminum materials is impressed with the positive rectangular pulse voltage, the aluminum material is oxidized to form thereon an aluminum oxide film containing suboxides of aluminum and other elements and having lattice defects and the sulfuric ions in the electrolyte enter into the lattice defects of the film, as described above in the item (1). However, unlike in the case of the item (1), the positive rectangular pulse voltage is impressed for a very short period of time, so that the reduction referred to above in the item (1) takes place only a little. The reduction of the sulfuric ions is effected mainly during the impression of the negative rectangular pulse voltage and the sulfur and/or the sulfides are reduced in the films and serve as coloring source, thus providing colored oxide films on the both aluminum materials at the same time.

A description will be given with regard to a proper range of characteristic values of the voltages of such waveforms as shown in FIGS. 1 and 2. With any pulse voltages other than such voltages as shown in FIGS. 1 and 2, a colored oxide film or films can readily be obtained, so long as their characteristic values lie within the suitable range described hereinbelow.

On the base voltages $E_1$ and $E_{1a}$:

The positive base voltage $E_1$ takes part in the formation of the aluminum oxide film and, in order to form the film thick, it is preferred to raise the positive base voltage as high as possible. However, too high a base voltage $E_1$ is liable to break down the film, so that the positive base voltage $E_1$ is preferred to be 40V or less.

Even if the positive base voltage $E_1$ is not ever applied, the aluminum oxide film is formed to some extent, since the rectangular pulse voltage $E_2$ is applied as described later. Accordingly, even if the positive base voltage $E_1$ is zero, a colored oxide film may well be formed.

The negative base voltage $E_{1a}$ takes part in the reduction of the sulfuric ions and so on in the case of simultaneously electrolyzing the aluminum materials used as the anode and the cathode but, with too a negative base voltage, the aluminum oxide film is liable to be dissolved and broken down and it is preferred to select the negative base voltage in the range of −40 to 0 volt. Especially, even if the negative base voltage is zero, a rectangular pulse voltage $E_{2a}$ is impressed, as described later, to promote the reduction of the sulfuric ions, so that even if the negative base voltage is zero and the base voltage is not applied, sulfur and/or sulfides are educed in the aluminum oxide film, providing colored oxide film on each aluminum material.

On the values $E_2$ and $E_{2a}$ of the pulse voltage:

With the positive value $E_2$, energy is given which is sufficient to attract the sulfuric ions to the aluminum oxide film and to cause them to enter into the lattice defects of the oxide film and, at the same time, a shock is applied to the oxide film to suppress its growth to produce an aluminum oxide film containing suboxides of aluminum such, for example, as AlO, $Al_2O$ and the like.

Accordingly, in the present invention, it is necessary to select the value $E_2$ sufficiently large to apply a sufficient shock to the aluminum oxide film to form lattice defects therein and to cause as many sulfuric ions as possible to enter deep into the lattice defects. From this point of view, it is preferred that the value $E_2$ is as large as possible, but too large a value leads to destruction of the aluminum oxide film. The value $E_2$ is preferred to be 120V or less. With the value $E_2$ being about 5V, the above effect can be obtained sufficiently.

The value $E_{2a}$in the negative direction contributes to the formation of sulfur and/or sulfides by reducing the sulfuric ions in the lattice defects in the case of simultaneous electrolyzation of the aluminum materials used as the anode and the cathode. Accordingly, the larger the value $E_{2a}$ is, the more the reduction of the sulfuric ions is prompted and the sulfuric ions present in deep lattice defects are completely reduced, thereby to provide for remarkedly enhanced effect of coloring the aluminum oxide. However, too large a value $E_{2a}$ leads to dissolution of the aluminum oxide film and, in view of this, it is preferred to select the value $E_{2a}$ in the range of −5 to 120V.

On the periods T and $T_a$ and the pulse durations $\tau$ and $\tau_a$:

It is necessary to properly determine the period T and the duration $\tau$. If they are improper, the effect of the impression of the pulse voltage is lost. It is preferred that where the period T is in the range of 0.2 to 120 sec., the duration $\tau$ is selected to range from 0.1 to 60 sec.

Where the period T has a value less than 0.2 sec., even if the duration $\tau$ is shorter than 0.1 sec., a colored oxide film can be formed. It is preferred that the period $T_a$ and the duration $\tau_a$ are selected as is the case with the period T and the duration $\tau$.

On the mean current density:

With the present invention, in the both cases of electrolyzing the aluminum material used as the anode and simultaneously electrolyzing the aluminum materials used as the anode and the cathode, an aluminum oxide film is formed during the impression of a positive voltage to the aluminum material and a shock is given to the film to produce a film having lattice defects. Accordingly, also in the present invention, it is necessary to form an aluminum oxide film of substantially the same thickness as that obtainable with an ordinary anodic oxidation treatment and positive and negative current densities are both required to be in the range of 0.5 to 20 A/dm².

On the duration of electrolysis:

Too short duration of electrolysis results in insufficient growth of the aluminum oxide film but, with too long duration, the film is not grown much. If the film is too thick, the film is easily cracked in a sealing treatment. From this point of view, it is usually proper to select the duration of electrolysis in the range of 30 to 90 minutes, preferably in the range of 30 to 60 minutes.

On the positive and negative current density in the case of simultaneous electrolyzation of aluminum materials used as the anode and the cathode:

During the impression of a positive pulse voltage to the aluminum material, an aluminum oxide film is formed and, during the impression of a negative pulse voltage, sulfuric ions are reduced and the film is dissolved. Accordingly, it is necessary to hold the mean current density $i$ and $i_a$ on the both aluminum materials at the aforesaid proper value and to retain the product of the positive or negative pulse voltage impression time $t$ or $t_a$ and the mean current density $i$ or $i_a$, that is, the positive or negative charge density on the aluminum material, at a proper value. According to our experiments, it has been ascertained to be proper that the absolute values of the mean current density $i$ and $i_a$ lie within the range of 0.5 to 7.0 A/dm² even if a pulse voltage of any waveform is impressed. Further, the ratio of the positive charge density and the negative charge density was important rather than the magnitude of the absolute value of the positive or negative charge density. If the positive charge density is too higher than the negative charge density, the formation or sulfur and/or sulfides resulting from reduction of sulfuric ions is insufficient and, in the opposite case, the formation of the aluminum oxide film is insufficient and the aluminum oxide film is much dissolved. It has been ascertained by our experiments that, in the present invention, the ratio of the positive charge density and the negative one is desirable to be $$\frac{i \text{ while positive} \times t}{i \text{ while negative} \times t_a}$$

On bath temperature:

The bath temperature is preferred to be in the range of 0° to 30°C. For example, at room temperature of 15°C, too, a colored oxide film can be formed. A low bath temperature facilitates the formation of suboxides of aluminum and so on but a cooling device is required, so that it is desirable to select the bath temperature at room temperature of about 15°C.

According to our experiments, it has been ascertained that where the above conditions are all satisfied, a colored oxide film could be formed electrolytically by impressing any voltages of the following waveforms other than the voltages of the waveforms shown in FIGS. 1 and 2.

1. Alternate application of positive and negative DC voltages. In this case however, the DC voltage includes a full-wave rectified voltage containing ripples a little.
2. Alternate application of a positive DC voltage and an AC voltage.
3. Sequential application of a positive DC voltage, an AC voltage and a negative DC voltage in this order.
4. Application of a voltage that a voltage obtained by full-wave or half-wave rectification of a single-phase or a multi-phase voltage is phase controlled by a silicon rectifier, a chopper or the like, or alternate application of positive and negative voltages of such waveform.
5. Application of a voltage that a single-phase sine wave voltage is phase controlled by a silicon rectifier or a chopper, or alternate application of positive and negative voltages of such waveform.
6. Application of a pulse voltage of, for example, a sawtooth, triangular or like waveform, or alternate application of positive and negative voltages of such waveform.

This invention will be further described by the following Examples.

EXAMPLE 1.

An aluminum material 6063, defatted and rinsed with water, was subjected to an anodic oxidation in an aqueous solution containing 7.0 to 30% by weight of $H_2SO_4$, with the aluminum being used as an anode and a graphite electrode as a cathode.

In this Example, the three kinds of voltages shown in FIG. 1 were impressed between the both electrodes. The results are as given in the following Table 1.

Table 1

| Voltage waveform conditions | | | | | | Electrolytic bath | | |
|---|---|---|---|---|---|---|---|---|
| $E_1$ | $E_2$ | T | $\tau$ | Current density (A) | Current density (B) | Concentration of $H_2SO_4$ | Temperature | Color of film |
| 30V | 40V | 1.1 sec. | 0.1 sec. | 4A/dm² | 10A/dm² | 7.0wt.% | 13°C | Deep |

Table 1-continued

| Voltage waveform conditions | | | | | | Electrolytic bath | | |
|---|---|---|---|---|---|---|---|---|
| $E_1$ | $E_2$ | T | $\tau$ | Current density (A) | Current density (B) | Concentration of $H_2SO_4$ | Temperature | Color of film |
| 20V | 10V | 5.5 sec. | 0.5 sec. | 2A/dm² | 10A/dm² | 17.0wt.% | 14°C | amber Slightly deep amber |
| 0V | 30V | 6 sec. | 5 sec. | 0 | 10A/dm² | 30.0wt.% | 15°C | Slightly light amber |

Current density (A) indicates the impression of only a constant voltage $E_1$ and current density (B) indicates the impression of of $(E_1 + E_2)$.

EXAMPLE 2.

An aluminum material 1,100, defatted and rinsed with water, was subjected to an electrolytic treatment in an aqueous solution containing 15% by weight of sulfuric acid by applying pulse voltages shown in FIG. 2 between the aluminum material acting as an anode and a carbon electrode as a counter electrode, for 60 minutes. The bath temperature as maintained at 25°C.

In this Example, the values of the pulse voltages applied between the aluminum material and the carbon electrode and the color of each film were as given in the following Table.

Table 2

| | Voltage (V) | | | | Pulse width (sec.) | | | | Ratio of charge density of both polarity | Color |
|---|---|---|---|---|---|---|---|---|---|---|
| | $E_1$ | $E_2$ | $E_{1a}$ | $E_{2a}$ | T | $\tau$ | $T_a$ | $\tau_a$ | | |
| 1 | 48 | 86 | −28 | −61 | 2 | 1 | 2 | 1 | 0.5 | Very light amber |
| 2 | 31 | 63 | −18 | −36 | 3 | 1 | 2 | 1 | 1.0 | Light amber |
| 3 | 56 | 115 | −32 | −76 | 5 | 1 | 2 | 1 | 1.5 | Amber |
| 4 | 34 | 69 | −18 | −38 | 10 | 2 | 2 | 1 | 4.0 | Very lightly grayish brown |

EXAMPLE 3.

Each of fourteen aluminum materials shown in Table 3 was subjected to an electrolytic treatment in an aqueous solution containing 7% by weight of sulfuric acid by applying the voltage of FIG. 1 between the aluminum material used as an anode and a graphite electrode as a cathode under such conditions as $E_1 = 30V$, $E_2 = 40V$, $T = 1.1$ sec., $\tau = 0.1$ sec., $A = 4$ A/dm², $B = 10$A/dm² and bath temperature = 15°C. Colored oxide films given in Table 4 were obtained.

Table 3

| Alloy (A.A.) | Aluminum | Copper | Iron | Silicon | Manganese | Magnesium | Zinc | Chromium | Titanium | Other elements Single amount | Other elements Total amount |
|---|---|---|---|---|---|---|---|---|---|---|---|
| 1099 | 99.99 min. | — | — | — | — | — | — | — | — | — | — |
| 1100 | 99.99 min. | — | — | — | — | — | — | — | — | — | — |
| 2011 | residue | 5.0~6.0 | 0.7 | 0.40 | — | — | 0.30 | — | — | 0.50 | 0.15 |
| 2014 | residue | 3.9~5.0 | 1.0 | 0.50~1.2 | 0.40~1.2 | 0.20~0.8 | 0.25 | 0.10 | 0.15 | 0.05 | 0.15 |
| 2024 | residue | 3.8~4.9 | 0.50 | 0.50 | 0.3~0.9 | 1.2~1.8 | 0.25 | 0.10 | — | 0.05 | 0.15 |
| 3003 | residue | 0.20 | 0.70 | 0.60 | 1.0~1.5 | — | 0.10 | — | — | 0.05 | 0.15 |
| 4043 | residue | 0.30 | 0.80 | 4.5~6.0 | 0.05 | 0.05 | 0.10 | — | 0.20 | 0.05 | 0.15 |
| 5005 | residue | 0.20 | 0.7 | 0.40 | 0.20 | 0.50~1.1 | 0.25 | 0.10 | — | 0.05 | 0.15 |
| 5052 | residue | 0.10 | maximum | 0.45 | 0.10 | 2.2~2.8 | 0.10 | 0.15~0.35 | — | 0.05 | 0.15 |
| 5086 | residue | 0.10 | 0.50 | 0.40 | 0.20~0.7 | 3.5~4.5 | 0.25 | 0.05~0.25 | 0.15 | 0.05 | 0.15 |
| 5357 | residue | 0.07 | 0.17 | 0.12 | 0.15~0.45 | 0.8~1.2 | — | — | — | 0.05 | 0.15 |
| 6061 | residue | 0.15~0.40 | 0.70 | 0.4~0.8 | 0.15 | 0.8~1.2 | 0.25 | 0.15~0.35 | 0.15 | 0.05 | 0.15 |
| 6063 | residue | 0.10 | 0.35 | 0.20~0.6 | 0.10 | 0.15~0.9 | 0.10 | 0.10 | 0.10 | 0.05 | 0.15 |
| 7075 | residue | 1.2~2.0 | 0.5 | 0.50 | 0.30 | 2.1~2.9 | 5.1~6.1 | 0.18~0.40 | 0.20 | 0.05 | 0.15 |

Table 4.

| Alloy (A.A.) | Color of film | Name of alloy | Color of film |
|---|---|---|---|
| 1100 | Brown | 5052 | Yellowish brown |
| 2011 | Blackish brown | 5086 | Blackish brown |
| 2014 | Blackish brown | 5357 | Grayish brown |
| 2024 | Yellowish brown | 6061 | Blackish brown |
| 3003 | Blackish brown | 6063 | Yellowish brown |
| 4043 | Blackish brown | 7075 | Yellowish brown |
| 5005 | Blackish brown | | |

Table 4 indicates that the color of the colored oxide film of the aluminum material containing much iron becomes darker with an increase in the amount of iron contained. By observing the constructions of all the films, it was found that sulfur and/or sulfides were deposited in the lattice defects in any one of the films.

As will be seen from the foregoing, with the present invention, a colored oxide film is obtained by effecting an anodic oxidizing treatment in an aqueous solution containing sulfuric acid, without employing any coloring additives. Accordingly, this invention has the following advantages.

1. The electrolytic solution is simple in composition and economical and control of the bath is easy.

2. Since sulfuric ions serving as coloring sources enter into lattice defects of an aluminum oxide film during its formation, the resulting color is constant and uniform and does not ever deteriorate the characteristic of the film.

3. Electrolysis is carried out in the aqueous solution containing sulfuric acid and productivity is also very excellent.

The aluminum material or an aluminum alloy herein mentioned is intended to cover an industrially pure aluminum, any other various aluminum alloys and, especially, those aluminum alloys containing oxidizable alloying elements but to exclude alloys containing a large amount of, for example, copper.

We claim as our invention:

1. A method of forming a colored oxide film on aluminum which contains incidental impurities and on aluminum alloys by electrolyzing the aluminum material by applying a rectangular pulse voltage thereto in an electrolytic bath consisting essentially of an aqueous solution of sulfuric acid to form an aluminum oxide film containing aluminum suboxides and having crystal lattice defects on the surface of the aluminum material, said rectangular pulse voltage having a peak voltage value in the range of from about 5 volts to about 120 volts and a period in the range of from about 0.2 seconds to about 120 seconds.

2. A method of forming a colored oxide film on an aluminum material according to claim 1, wherein said rectangular pulse voltage includes a positive pulse voltage for the formation of the aluminum oxide film and for driving the sulfuric ions into the lattice defects.

3. A method of forming a colored oxide film on an aluminum material according to claim 2, wherein said rectangular pulse voltage includes a negative pulse voltage to promote the reduction of the sulfuric ions to form sulfur and sulfides.

4. A method of forming a colored oxide film on an aluminum material according to claim 1, wherein the aqueous solution contains 5 to 90% by weight of sulfuric acid.

5. A method of forming a colored oxide film on an aluminum material according to claim 1, wherein the aluminum material is an aluminum alloy containing an element whose affinity with oxygen is equal to or stronger than that of aluminum or stronger than copper.

* * * * *